United States Patent [19]

Le Febvre

[11] 4,199,121

[45] Apr. 22, 1980

[54] INVERTIBLE RAIN GUTTER MOUNTING APPARATUS

[76] Inventor: Alfred F. Le Febvre, 67 Prospect St., Bloomfield, Conn. 06002

[21] Appl. No.: 24,792

[22] Filed: Mar. 28, 1979

[51] Int. Cl.[2] ..... E04D 13/06

[52] U.S. Cl. ..... 248/48.2; 52/12; 248/202.1

[58] Field of Search ..... 248/48.1, 48.2; 52/12, 52/14; 405/118; 134/33

[56] References Cited

U.S. PATENT DOCUMENTS

| | | | |
|---|---|---|---|
| 288,307 | 11/1883 | Campbell | 248/48.2 |
| 1,414,345 | 5/1922 | Eeftink | 248/48.2 |
| 2,596,553 | 5/1952 | Henry | 248/48.1 |
| 2,925,976 | 2/1960 | Martin | 248/48.2 |
| 3,091,055 | 5/1963 | Hegequsich | 248/48.2 X |
| 3,630,473 | 12/1971 | Landis | 248/48.2 |
| 3,752,428 | 8/1973 | Trostle | 248/48.2 |
| 4,061,151 | 12/1977 | Ward | 174/33 |

*Primary Examiner*—J. Franklin Foss
*Attorney, Agent, or Firm*—Stephen E. Revis

[57] ABSTRACT

A support system which enables a rain gutter to be inverted and emptied of debris includes a link pivoted at its rear end to a bracket attached to a building, and at its front end to the gutter. The gutter can pivot about the front end of the link to an inverted position. In its normal position the gutter rests on support arms extending outwardly from the building underneath the gutter. The support system is usable with all commercially available gutters.

8 Claims, 5 Drawing Figures

FIG. 1
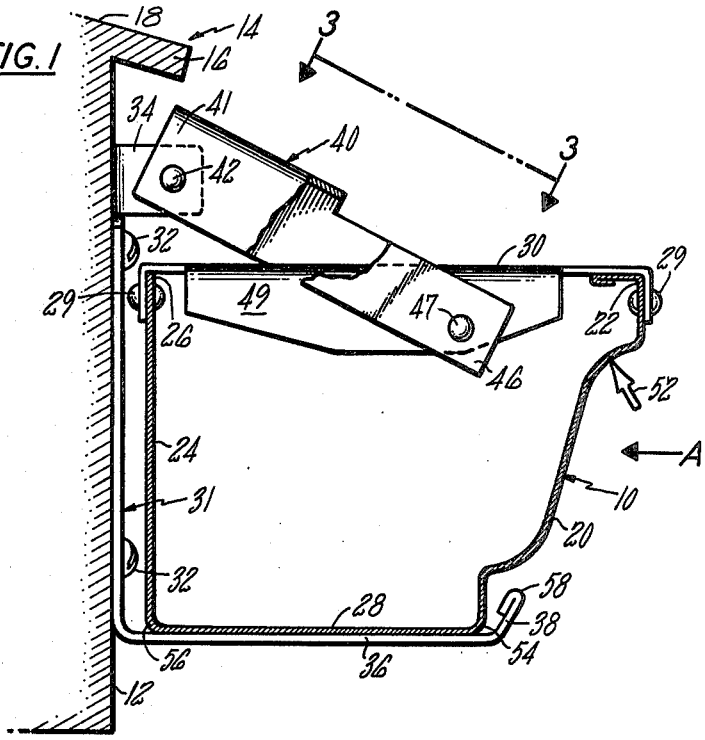
FIG. 2
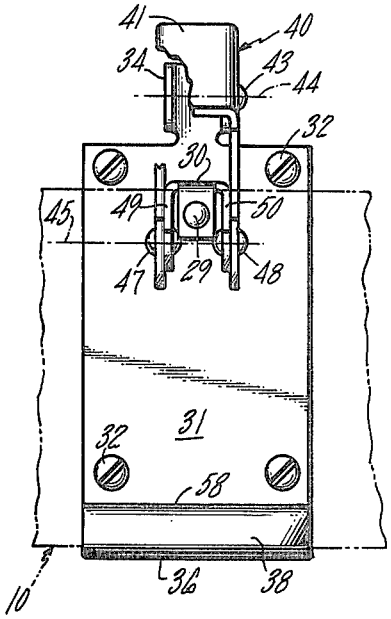
FIG. 4
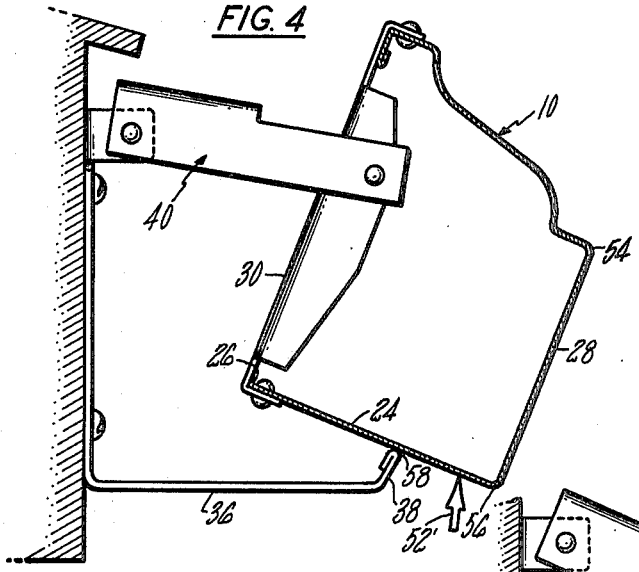
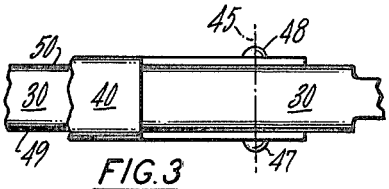
FIG. 3
FIG. 5
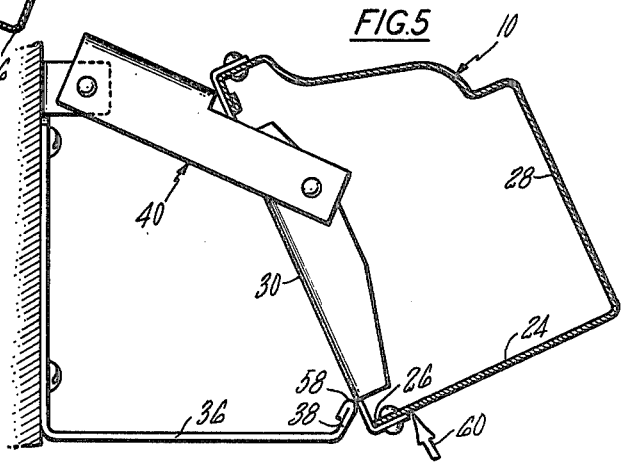

INVERTIBLE RAIN GUTTER MOUNTING APPARATUS

BACKGROUND OF THE INVENTION

Field of the Invention—This invention relates to rain gutters and in particular to invertible rain gutters.

Description of the Prior Art—Invertible rain gutters are well known in the art. Typical invertible rain gutters are shown and described in the following U.S. Pat. Nos.: 538,108; 1,141,204; 3,091,055; 4,061,151; 4,072,285; 4,116,008; and 4,117,635.

Each of the inventions described in these patents involves either complicated and costly apparatus, or requires a specially designed gutter. Clearly, neither of the foregoing is desirable. It is also interesting to note (and perhaps it has contributed to the complexity of the prior art designs) that, in every one of the above mentioned patents, the apparatus is designed such that the gutter rotates about a fixed, horizontal axis, parallel to the length of the gutter.

SUMMARY OF THE INVENTION

One object of the present invention is inexpensive rain gutter mounting apparatus which permits inverting the rain gutter.

Another object of the present invention is a simple mounting system for rain gutters which permits easy inversion of the rain gutters for cleaning them of debris.

A further object of the present invention is apparatus for mounting rain gutters which is usable with virtually any commercially available gutter, and which permits the gutters to be inverted.

Accordingly, the present invention is a rain gutter support system including a link, adapted to be pivotally secured at its rear end to a bracket attached to a building and pivotally secured at its front end to the gutter, so that the gutter can rotate about said front end of the link to an inverted position.

In a preferred embodiment the bottom of the gutter rests on a fixed support arm which is secured to and extends outwardly from the building under the gutter. The link is pivotally secured at its rear end to a bracket mounted just under the eave of the building so that the link rotates about a horizontal axis which is parallel to the length of the gutter. The free front end of the link is pivotally attached to a brace extending from the top front edge of the gutter to the top rear edge of the gutter. Since the only hard connection between the gutter and the face of the building is the rotatable link, the gutter can readily be lifted off the support arm upon which it rests, and be rotated about the front end of the link, which is free to move in a vertical plane as it rotates about its rear pivot point.

It is particularly convenient and preferred that the support arm extending outwardly from the building be horizonally aligned with the brace and extend a distance away from the building so that the brace, and therefore the gutter, rests against the front edge of the support arm when the gutter is in its inverted position.

The simplicity and low cost of the mounting system of the present invention are two clear advantages over the prior art; yet the invention is easily adaptable for use with virtually any commercially available gutter. Furthermore, as will be made clearer by the Description of Preferred Embodiments, the mount system may readily be designed so that the gutter may be inverted and then returned to its usual position from the ground, using the end of a pole.

The foregoing and other objects, features, and advantages of the present invention will become more apparent in the light of the following detailed description of preferred embodiments thereof as illustrated in the accompanying drawing.

BRIEF DESCRIPTION OF THE DRAWING

FIG. 1 is a cross-sectional view of a gutter mounted with the apparatus of the present invention and in its normal, rain catching position.

FIG. 2 is a front elevation view of the mounting apparatus of the present invention, looking in the direction A of FIG. 1.

FIG. 3 is a partial view taken along the line 3—3 of FIG. 1.

FIG. 4 is a cross-sectional view of the mounting apparatus of the present invention, showing the gutter in an intermediate position.

FIG. 5 is a cross-sectional view of the mounting apparatus of the present invention, showing the gutter in its inverted position.

DESCRIPTION OF PREFERRED EMBODIMENTS

As an exemplary embodiment of the present invention reference is made to FIGS. 1–5 which show a rain gutter, generally represented by the numeral 10, and a support system for the gutter which readily permits the gutter to be inverted in order to clean it of debris. In FIG. 1 the numeral 12 represents the face of a house 14 having a roof 18 which includes an eave 16. In this figure, and in FIG. 2, the gutter is shown in its usual upright or "rain catching" position. The gutter comprises a front wall 20 having an upper front edge 22, a rear wall 24 having an upper rear edge 26, and a bottom wall 28. Extending from the front edge 22 to the rear edge 26 of the gutter, and fixedly secured thereto by rivets 29, is a brace 30. The brace 30 provides structural integrity to the gutter, and, in this embodiment, also serves as a location for a hinge from which the gutter is to be hung, as will be hereinafter explained.

The gutter support system comprises a bracket 31 which is fixedly secured to the face 12 of the house 14 just under the eave 16 by screws 32 or other suitable means. The bracket 31 includes an upper hinge portion 34 and a lower supporting arm 36. The supporting arm 36 includes an upturned lip 38 at its forward end. The bottom 28 of the gutter 10 rests on the arm 36, which provides vertical support for the gutter when the gutter is in its upright position.

The support system also includes a link 40 whose rearward end 41 is pivotally connected to the hinge element 34 by loose fitting rivets 42 and 43. The common axis 44 of the rivets 42 and 43, which is the axis of rotation of the link 40, is horizontal and parallel to the length of the gutter 10, so that the link 40 rotates in a vertical plane which is perpendicular to the face 12 of the house 14. The front end 46 of the link 40 is pivotally attached to the gutter 10 by means of loose fitting rivets 47 and 48 which pass through side walls 49 and 50, respectively, of the brace 30. The common axis 45 of the rivets 47 and 48 is also horizontal and parallel to the length of the gutter. In this embodiment the axis 45 is rearward of the front wall 20, forward of the rear wall 24, and above the bottom wall 28. As explained below, this is not mandatory; however, the advantages of this particular location for the axis 45 will become apparent hereinafter in the description of the operation of the apparatus. Also, although only a single bracket 31 and link 40 are shown, it should be apparent that most support systems will comprise brackets and links at several locations along the length of the gutter.

To invert the gutter a force such as represented by the arrows 52 may be applied from the ground (such as with the end of a pole) to the front wall 20 of the gutter and forward of the axis 45 so as to create an upward force on the gutter 10 as well as a counterclockwise rotational force or moment about the axis 45. Upon initial application of the force 52 the link 40 begins to rotate counterclockwise about the axis 44, and the lower front edge 54 of the gutter lifts off the support arm 36. As the upper front edge 22 of the gutter continues to be pushed upward and in an arc about the axis 45, the bottom rear edge 56 of the gutter 10 slides forward along the support arm 36.

Eventually the bottom rear edge 56 of the gutter will be forward of the upturned lip 38 of the support 36; and the rear wall 24 of the gutter will be resting on the forward most edge 58 of the support arm 36. This intermediate position is shown in FIG. 4. In this position, when the force 52 is removed the gutter will not return to its original position. The rotating force is then preferably reapplied against the exposed, overhanging rear wall 24 of the gutter as shown in FIG. 4, wherein the reapplied force is represented by the arrow 52'. Rotation of the gutter is continued in this manner until the upper rear edge 26 of the gutter is forward of the upturned lip 38, as shown in FIG. 5. The gutter is now inverted; and when the force 52' is removed, the brace 30 will rest against the edge 58 of the support arm 36, and the gutter will remain in the inverted position.

The gutter may be returned to its original position by applying a force roughly in the direction of the arrow 60, which will lift the gutter up as the link 40 rotates counterclockwise. When the upper rear edge 26 of the gutter is above the front edge 58 of the lip 38 the gutter will begin to rotate clockwise back toward its upright position. As the gutter rotates clockwise the force 60 can be reapplied at the appropriate location so as to continue the gutter in its clockwise rotation until it is back in its original upright position.

As mentioned above, it is not mandatory that the axis 45 be located between the front and rear walls of the gutter. Nor is it necessary that the brace 30 be used as a hinge point for the link 40. There may, for example, be a separate hinge element secured to the front wall 20 of the gutter to which the link 40 could instead be pivotally attached. Braces 30, if required at all, may be disposed anywhere along the length of the gutter and play no part in the actual mounting of the gutter (i.e., they would simply provide structural rigidity to the gutter).

It is also contemplated as within the scope of the present invention that the front end of the link 40 be pivotally connected to the gutter through an axis located forward of the front wall 20. Although this may make it difficult to invert the gutter from the ground and return it to its normal position, the gutter could still be easily inverted by hand. Clearly, the pivot points of the link 40 could be located in many different positions and would still permit inversion of the gutter.

Along these same lines, the support arm 36 need not be part of the bracket 31. Support arms may be located anywhere along the length of the gutter, preferably aligned with a brace member or other feature of the gutter which could rest on the forward edge of the support arm when the gutter is inverted.

Although the invention has been shown and described with respect to preferred embodiments thereof, it should be understood by those skilled in the art that other various changes and omissions in the form and detail thereof may be made therein without departing from the spirit and the scope of the invention.

Having thus described typical embodiments of my invention, that which I claim as new and desire to secure by Letters Patent of the United States is:

1. A rain gutter support system adapted to be secured to a gutter having a front, rear, and bottom wall and to the face of a building to which the gutter is to be installed, and which permits the gutter to be inverted, said system comprising:

a stationary supporting arm adapted to be secured to the face of the building and to extend outwardly therefrom under and in supporting contact with the gutter when the gutter is in its normal upright position;

bracket means including a fixed element and a rotatable link, said fixed element adapted to be secured to the face of the building, said link including a front end and a rear end, said rear end being pivotally attached to said fixed element along a horizontal first axis parallel to the length of the gutter, and said front end adapted to be pivotally attached to the gutter along a horizontal second axis parallel to and forward of the first axis and which is located so as to permit the gutter to be rotated about said second axis to an inverted position.

2. The rain gutter support system according to claim 1 wherein said front end of said link, including said second axis, is located forward of said rear wall, rearward of said front wall, and above said bottom wall of the gutter.

3. The rain gutter support system according to claim 1 including brace means, wherein said front end of said link is pivotally attached to said brace means along said second axis, and said brace means is adapted to extend from the front to the rear wall of the gutter and to be fixedly secured to both said front and rear walls.

4. The rain gutter support system according to claim 3 wherein said supporting arm has a front edge, and said brace means is adapted to rest against said front edge when the gutter is in an inverted position.

5. A rain gutter assembly including a gutter and a support system for said gutter, wherein said gutter includes a front wall having an upper front edge, a rear wall having an upper rear edge, and a bottom wall interconnecting said front and rear walls, and said support system comprises a stationary supporting arm, a bracket element, and a link having a forward and rearward end, said arm and said bracket element adapted to be fixedly secured to the face of a building, said arm being disposed under said gutter wherein said gutter rests on said arm when said gutter is in an upright position, said link along a horizontal second axis parallel to the length of said gutter and forward of said first axis permitting rotation of said gutter about said second horizontal axis to an inverted position.

6. The rain gutter assembly according to claim 5 wherein said second axis is located forward of said rear wall, rearward of said front wall, and above said bottom wall of the gutter.

7. The rain gutter assembly according to claim 6 wherein said gutter includes a brace member extending from said upper rearward edge to said upper forward edge, said forward end of said link being pivotally secured to said brace member along said horizontal second axis.

8. The rain gutter assembly according to claim 7 wherein said supporting arm has a front edge, and said brace member is adapted to rest against said front edge when the gutter is in an inverted position.

* * * * *

UNITED STATES PATENT AND TRADEMARK OFFICE

CERTIFICATE OF CORRECTION

PATENT NO. : 4,199,121

DATED : April 22, 1980

INVENTOR(S) : ALFRED F. LE FEBVRE

It is certified that error appears in the above-identified patent and that said Letters Patent are hereby corrected as shown below:

Claim 5, column 4, line 59: after the word "link" insert the following:

--being pivotally secured at its rearward end to said bracket element along a horizontal first axis parallel to the length of said gutter, and said gutter being pivotally secured to said forward end of said link--

Signed and Sealed this

*Second* Day of *September 1980*

[SEAL]

*Attest:*

SIDNEY A. DIAMOND

*Attesting Officer*

*Commissioner of Patents and Trademarks*